US008889065B2

(12) United States Patent
Chelluri et al.

(10) Patent No.: US 8,889,065 B2
(45) **Date of Patent: *Nov. 18, 2014**

(54) MICRON SIZE POWDERS HAVING NANO SIZE REINFORCEMENT

(75) Inventors: Bhanumathi Chelluri, Dublin, OH (US); Edward Arlen Knoth, Beavercreek, OH (US); Edward John Schumaker, Riverside, OH (US); Ryan D. Evans, N. Canton, OH (US); James. L. Maloney, III, Canton, OH (US)

(73) Assignee: IAP Research, Inc., Dayton, OH (US)

( * ) Notice: Subject to any disclaimer, the term of this patent is extended or adjusted under 35 U.S.C. 154(b) by 765 days.

This patent is subject to a terminal disclaimer.

(21) Appl. No.: 11/531,771

(22) Filed: Sep. 14, 2006

(65) Prior Publication Data

US 2008/0069716 A1 Mar. 20, 2008

(51) Int. Cl.

| | |
|---|---|
| ***B22F 7/04*** | (2006.01) |
| ***B22F 1/02*** | (2006.01) |
| ***B22F 9/04*** | (2006.01) |
| ***C22C 49/11*** | (2006.01) |
| ***C22C 1/10*** | (2006.01) |
| ***C22C 32/00*** | (2006.01) |
| ***B22F 1/00*** | (2006.01) |
| ***C22C 47/14*** | (2006.01) |

(52) U.S. Cl.

CPC ..... *C22C 1/1084* (2013.01); *B22F 2009/043* (2013.01); *C22C 49/11* (2013.01); *C22C 32/0084* (2013.01); *B22F 1/02* (2013.01); *B22F 1/0014* (2013.01); *C22C 32/0047* (2013.01); *C22C 47/14* (2013.01); *B22F 2998/10* (2013.01)

USPC ..... 419/32; 419/6; 419/10; 419/11; 419/12; 419/13; 419/14; 419/17; 419/19; 75/252

(58) Field of Classification Search

USPC ..... 75/746–773, 950, 951, 956, 228–255, 75/300, 330; 419/1, 5–22, 30–52, 60–69, 419/23, 24, 56, 57; 148/421, 513, 514, 537; 427/180–206, 212–222, 294, 295; 428/539.5

See application file for complete search history.

(56) References Cited

U.S. PATENT DOCUMENTS

| | | | |
|---|---|---|---|
| 3,066,391 | A | 12/1962 | Vordahl |
| 3,208,848 | A | 9/1965 | Levey, Jr. |

(Continued)

FOREIGN PATENT DOCUMENTS

| | | | |
|---|---|---|---|
| EP | 10 07 750 | B1 | 2/1999 |
| EP | 1174385 | A2 | 1/2002 |

(Continued)

OTHER PUBLICATIONS

Eylon, Daniel, Froes, F.H. (Sam), Abkowitz, Stanley, "Titanium Powder Metallurgy Alloys and Composites," vol. 7: Powder Metal Technologies and Applications, ASM Handbooks Online, 2002. (26 pages total).*

(Continued)

*Primary Examiner* — Scott Kastler
*Assistant Examiner* — Vanessa Luk
(74) *Attorney, Agent, or Firm* — Jacox, Meckstroth & Jenkins

(57) ABSTRACT

An improved sintered material and product. A nanometer size reinforcement powder is mixed with a micron size titanium or titanium alloy powder. After the reinforcement powder is generally uniformly dispersed, the powder mixture is compacted and sintered, causing the nano reinforcement to react with the titanium or titanium alloy, producing a composite material containing nano and micron size precipitates that are uniformly distributed throughout the material.

20 Claims, 7 Drawing Sheets

(56) References Cited

U.S. PATENT DOCUMENTS

| | | | | |
|---|---|---|---|---|
| 3,416,918 | A | 12/1968 | Henry | |
| 3,660,049 | A | 5/1972 | Benjamin | |
| 3,741,748 | A * | 6/1973 | Fustukian et al. | 75/252 |
| 4,749,545 | A | 6/1988 | Begg et al. | |
| 4,818,567 | A * | 4/1989 | Kemp et al. | 427/216 |
| 4,873,148 | A * | 10/1989 | Kemp et al. | 428/570 |
| 5,118,342 | A * | 6/1992 | Kamimura et al. | 75/235 |
| 5,175,056 | A * | 12/1992 | Teichmann | 428/403 |
| 5,372,845 | A * | 12/1994 | Rangaswamy et al. | 427/216 |
| 5,589,652 | A * | 12/1996 | Arato et al. | 75/235 |
| 5,631,044 | A * | 5/1997 | Rangaswamy et al. | 427/216 |
| 5,750,249 | A * | 5/1998 | Walther et al. | 428/328 |
| 5,835,841 | A * | 11/1998 | Yamada et al. | 428/546 |
| 5,854,966 | A * | 12/1998 | Kampe et al. | 419/67 |
| 5,993,731 | A * | 11/1999 | Jech et al. | 419/19 |
| 6,228,481 | B1 * | 5/2001 | Yamada et al. | 428/403 |
| 6,264,719 | B1 | 7/2001 | Zhang et al. | |
| 6,652,967 | B2 * | 11/2003 | Yadav et al. | 428/403 |
| 6,656,246 | B2 | 12/2003 | Kanoya et al. | |
| 6,855,426 | B2 * | 2/2005 | Yadav | 428/403 |
| 7,060,120 | B1 | 6/2006 | Kanoya et al. | |
| 7,758,784 | B2 * | 7/2010 | Chelluri et al. | 264/122 |
| 2002/0033209 | A1 | 3/2002 | Kanoya et al. | |
| 2005/0268746 | A1 | 12/2005 | Abkowitz et al. | |
| 2007/0057415 | A1 | 3/2007 | Katagiri et al. | |

FOREIGN PATENT DOCUMENTS

| | | | |
|---|---|---|---|
| FR | 2782096 | A1 | 2/2000 |
| GB | 1046330 | A | 10/1966 |
| GB | 1280833 | A | 7/1972 |
| JP | 2002053902 | A | 2/2002 |
| WO | 99/09227 | A1 | 2/1999 |
| WO | 2005040068 | A1 | 5/2005 |
| WO | 2007004635 | A2 | 4/2007 |

OTHER PUBLICATIONS

Glossary of Metallurgical and Metalworking Terms, Metals Handbook, ASM Handbooks Online, ASM International, 2002.*

Particle Size-Mesh Conversions, Sigma Aldrich.*

C. Suryanarayana, "Mechanical Alloying," vol. 7, ASM Handbook, ASM International, 2002.*

E.B. Taddei et al., "Production of new titanium alloy for orthopedic implants," Materials Science & Engineering C, 24, 2004, pp. 683-687, available online Sep. 29, 2004.*

Tsipas, S. et al.: "Effect of High Energy Ball Milling on Titanium-Hydroxyapatite Powders," Powder Metallurgy, Maney Publishing, London, GB, vol. 46, No. 1, Mar. 2003, pp. 73-77, XP001162474.

Dudina, D., Dae-Hwan Kwon, Khoa Xuan Huynh, Thuy Dang Nguyen, Ji-Soon Kim, Young-Soon Kwon. (2005),"Nanoscale TiB/sub 2/-dispersed Cu-matrix composite produced by a high-energy milling and self-propagating high-temperature synthesis process", Proceedings. The 9th Russian-Korean International Symposium on Science and Technology, (IEEE Cat. No. 05EX1018); 430-433.

Emura, S.; Hagiwara, M. (2001) Mechanical properties of TiB particulate reinforced Ti2AINb intermetallics produced by prealloyed powder metallurgy method. International Journal of Materials and Product Technology,16, (1-3): 103-108.

Fogagnolo J. B., Robert M. H., Torralba J. M.;"The effects of mechanical alloying on the extrusion process of AA 6061 alloy reinforced with Si3N4". J. Braz. Soc. Mech. Sci. & Eng., 25 (2), Apr./Jun. 2003.

Guo-Dong Zhan; Kuntz, J., Wan, J., Garay, J., Mukherjee, A. K. (2002), "Syntheses of Nd/sub 2/Ti/sub 2/O/sub 7//Al/sub 2/O/sub 3/ nanocomposites by spark-plasma-sintering and high-energy ball-milling"; Ultrafine Grained Materials II. Proceedings. TMS Annual Meeting, pp. 219-224.

Jeong, H. W.; Kim, S. J.; Hyun, Y. T.; Lee, Y. T. (Feb. 2002) Densification and compressive strength of in-situ processed Ti/TiB composites by powder metallurgy. Metals and Materials, 8, (1): 25-35.

Kamiya, Akira; Watazu, Akira; Zhu, Jun; Naganuma, Katsuyoshi (2000) Fabrication of alumina chopped fiber reinforced titanium matrix composites. Journal of Materials Science Letters, 19 (6): 461-464.

Kawabata, K.; Sato, E.; Kuribayashi, K. (2001) Creep behavior of in-situ TiB fiber reinforced Ti matrix composite. Proceedings of the 9th International Conference on Creep & Fracture of Engineering Materials & Structures: 331-339.

Kunrath, A. O.; Strohaecker, T. R.; Moore, J. J. (Jan. 15, 1996) Combustion synthesis of metal-matrix composites. I. The Ti—TiC—Al2O3 system. Scripta Materialia, 34, (2): 175-181.

Ismail, R., Yaacob, I. I.; "Synthesis and characterization of nanocrystalline Ni/sub 3/Al intermetallic via mechanical alloying and reaction synthesis". Key Engineering Materials (Switzerland), vol. 306-308: 1121-1126, (2006).

Lu, W ; Zhang, D.; Zhang, X.; Wu, R.; Sakata, T.; Mori, H (Nov. 2000) Microstructure and compressive properties of in situ synthesized (TiB+TiC)/Ti composites. Materials Transactions, JIM, 41, (11):1555-1561.

(Oct.-Dec. 1999) APIC—revolutionary new process for metal-matrix composites. Composites & Adhesives Newsletter, 16, (1): 4.

Peng, L. M.; Zhu, S. J. (2003) Creep of metal matrix composites reinforced by combining nano-sized dispersoids with micro-sized ceramic particulates or whiskers (review). International Journal of Materials and Product Technology, 18, (1-3): 215-254.

Prabhu, B., Suryanarayana, C., An L., Vaidyanathan R. (2006); "Synthesis and characterization of high volume fraction Al—Al2O3 nanocomposite powders by high-energy milling"; Materials Science and Engineering A, 425: 192-200.

Singh, P., Umesh, P. (1998) "Sintered nickel steel matrix composites produced by mechanical alloying"; Advances in Powder Metallurgy & Particulate Materials, vol. 2, Parts 5-9: 6.49-6.61.

Smith, R.W. Feb. 1, 1993) Reactive plasma spray forming for advanced materials synthesis. Powder Metallurgy International, 25 (1): 9-16.

Tomasi, R., Rabelo, A. A., Chinelatto, A. S. A., Reis, L., Botta, W. J. ; "Characterization of high-energy milled alumina powders. Ceramica, (Sep.-Oct. 1998) ; pp. 166-170".

Wang, Z.; Li, M. L.; Shen, Q.; Zhang, L. M. (2003) Fabrication of Ti/Al2O3 composites by spark plasma sintering. Key Engineering Materials, 249: 137-140.

Woodman, R H, Klotz, B R, Dowding, R J. (2005) ; "Evaluation of a dry ball-milling technique as a method for mixing boron carbide and carbon nanotube powders". Ceramics International, 31 (5): 765-768.

Wu, R. J.; Lu, W. J.; Zhang, D.; Zhang, X. N.; Sakata, T.; Mori, H (Oct. 2000) HREM study of TiB/Ti interfaces in a Ti—TiB—TiC in-situ composite. International Conference on Composite Interfaces, 8: 11.

Zhang, D.L., Cai, Z. H. (2003); "Sintering and Mechanical Properties of Titanium Based Metal-Ceramic Composites Produced from Reduction of Titanium Dioxide"; Materials Science Forum. vols. 437-438: 297-300.

Zhang, D.L.; (2004) Processing of Advanced Materials Using High-Energy Mechanical Milling. Progress in Materials Science (UK), vol. 49; No. 3-4: pp. 537-560.

Zhang, X. N.; Wu, R. J. (2003) Manufacture and performance of particulate reinforced titanium matrix composites. Key Engineering Materials, 249: 205-210.

* cited by examiner

FIG. 6
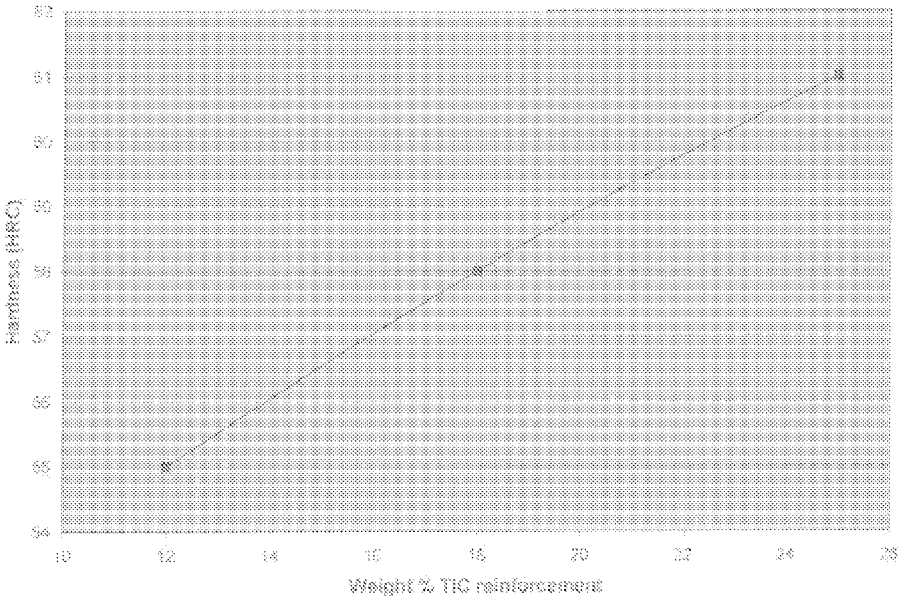
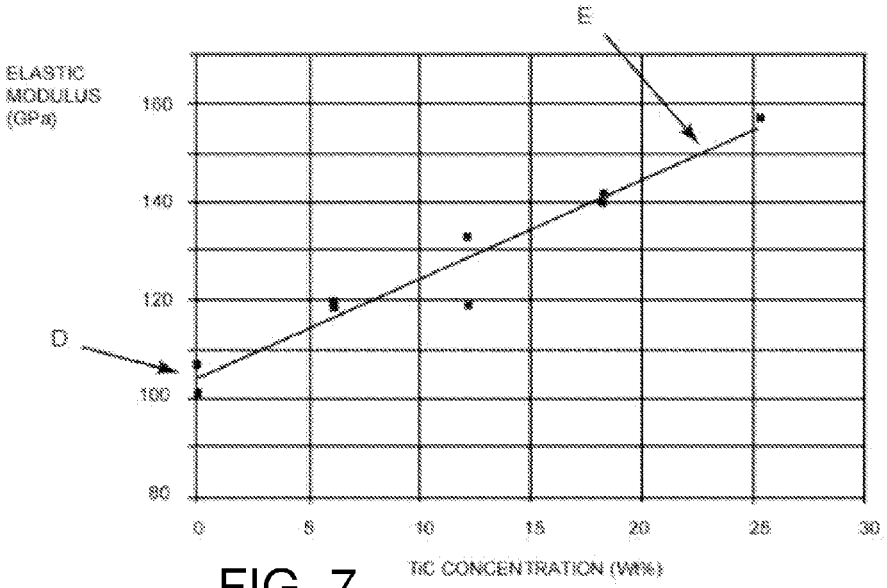
FIG. 7

MICRON SIZE POWDERS HAVING NANO SIZE REINFORCEMENT

STATEMENT OF GOVERNMENT INTEREST

This invention was made with United States Government support under SBIR Grant No. DE-FG02-03ER-83679. The United States Government has certain rights in this invention.

The claimed invention resulted from joint work by IAP Research, Inc. and The Timken Company under the SBIR program.

RELATED APPLICATION

This patent application is related to that entitled "METHOD OF PRODUCING UNIFORM BLENDS OF NANO AND MICRON POWDERS," Ser. No. 11/531,768, filed Sep. 14, 2006, and which is hereby incorporated by reference and made a part hereof.

BACKGROUND OF THE INVENTION

1. Field of the Invention

This invention relates to powders for compaction and sintering and, more particularly, to micron size powders having nano size reinforcements.

2. Description of the Related Art

Composite materials containing two different components are well known. Reinforced concrete provides a simple example. FIG. 1A illustrates a non-reinforced concrete beam 3. A load 6 will tend to deform the beam 3, inducing cracks 9 on the tension side 12, which can cause the beam 3 to fail.

FIG. 1B illustrates a reinforced concrete beam 18, which contains a steel reinforcing bar 21 on the tension side 12. The reinforcing bar 21 absorbs the tensile load on the tension side 12. The concrete itself, being high in compressive strength, absorbs the compressive load on the compression side 24.

The reinforced beam of FIG. 1B can carry a larger load than the non-reinforced beam of FIG. 1A by properly combining the desirable properties of two different materials, steel and concrete.

Similar principles of reinforcement have been applied to sintered materials. Studies exist where reinforcements of small whiskers or fibers of high tensile strength, having diameters in the range of several microns, have been incorporated into the sintered materials. Similarly, particulate reinforcements of micron size (1-100 microns) have been incorporated into matrix powder and sintered to obtain sintered composite body.

For example, titanium particulates, larger than 10 microns, have been mixed with carbon or boron fibers, also larger than 10 microns. The mixture is then compacted and subjected to a sintering process, wherein the carbon or boron reacts in situ with the titanium, to form precipitates of titanium carbide or titanium boride reinforcement.

It is known that nano grain size materials show unique properties such as mechanical, optical, electrical, and catalytical properties.

However, difficulty has been encountered in attempts to fabricate very small reinforcements, in the nanometer range, within a powder matrix in the micron range. Specifically, if the titanium micron powder of the example immediately above is mixed with titanium carbide particulates in the nanometer range, using ordinary agitation techniques, it is found that the carbide powder agglomerates together, forming islands, and does not become uniformly distributed throughout the titanium powder matrix.

FIG. 2 illustrates a specific example of non-uniformity. A micron size powder was mixed with a nano size powder, compacted and sintered. The dark islands indicate the titanium carbide produced by the nano powder, and the surrounding white regions indicate the titanium metallic regions.

What is needed is a system and method that overcomes one or more of the problems of the prior art, and that attains a more uniform distribution of nano size powders within a micron size matrix.

SUMMARY OF THE INVENTION

In one form of the invention, an approach has been developed which effectively disperses nano size discontinuous reinforcements generally uniformly throughout a micron size titanium or titanium alloy powder.

An object of the invention is to provide an improved process for blending nano size discontinuous reinforcements with micron-size titanium or titanium alloy powders.

A further object of the invention is to provide a process for blending nano-powders with micron powders of titanium or titanium alloy, which produces a generally highly uniform distribution of both entities throughout the mixture.

A further object of the invention is to provide blends of titanium or titanium alloy powders of micron and nano powders as precursors in a sintering process, wherein the nano powders form reinforcement.

In one embodiment of this invention, superior mechanical properties (that were not possible with micron reinforcements) is made possible by combining nano powder reinforcements with micron size powders.

In one aspect, one embodiment comprises a material, comprising: a collection of relatively soft particles, each smaller than 200 microns, and ranging in size from S1 to S2; and a coating of relatively hard particles embedded into each soft particle, the hard particles ranging in size from <S1/1000 to <S2/1000.

In another aspect, one embodiment comprises a material, comprising relatively soft particles, each smaller than 200 microns; and relatively hard particles, each smaller than 100 nanometers, which are uniformly dispersed among the relatively soft particles.

In still another aspect, one embodiment comprises a method comprising: combining a nano-sized powder of one material with a micron-sized titanium or titanium alloy powder; and ball-milling the particles to produce a mixture in which the number of nano-sized particles in any volume is substantially proportional to the surface area of micron-sized particles in the volume.

In yet another aspect, one embodiment comprises a method, comprising: combining micron size particles of a titanium or titanium alloy with nano size particles of a reinforcement; agitating the combined particles in a ball mill; and compacting and sintering the agitated particles, to thereby produce enhanced hardness in a sintered product. The hardness of sintered composite body was proportional to an amount of reinforcement particles used. The composite hardness is much higher than that of pure metal. The composite hardness is also higher than that made with micron size reinforcement.

In another aspect, one embodiment comprises a method, comprising: combining micron size particles of a titanium or titanium alloy with nano size particles of a reinforcement; agitating the combined particles in a ball mill; and compacting and sintering the agitated particles, to thereby produce a sintered product with modulus of elasticity that is higher than that of pure metal and composite made with micron size reinforcement. The sintered composite body modulus of elasticity increased linearly with amount of nano reinforcements.

In still another aspect, one embodiment comprises a composite, comprising: sintered titanium or titanium alloy and filaments or plates of reinforcement, said reinforcement being harder than the matrix, uniformly distributed throughout the matrix, and of diameter less than 500 nanometers.

In yet another aspect, one embodiment comprises a method, comprising: uniformly dispersing nanometer size reinforcements throughout a micron size titanium or titanium alloy powder; compacting and sintering the titanium or titanium alloy powder with reinforcement, to produce a sintered composite material having nanometer sized ceramic bodies uniformly distributed throughout the material.

These and other objects and advantages of the invention will be apparent from the following description, the accompanying drawings and the appended claims.

BRIEF DESCRIPTION OF THE DRAWINGS

FIG. 6 is a plot of hardness of the titanium composite reinforced with nano particulate TiC of three different weight concentrations (12, 18, and 25 percent);

FIG. 7 is a plot of modulus of elasticity increase as a function of TiC concentration for different concentrations of titanium carbide within titanium.

DETAILED DESCRIPTION OF THE INVENTION

A micron size titanium powder, ranging in size from 1 microns to 200 microns, is mixed with a nano size reinforcing powder, ranging in size from 1 nanometers to 100 nanometers, or even greater than 100 nanometers to less than 1 micrometer. The uniform blends are prepared by ball milling micron size titanium powders with nano size reinforcements.

The amount of nano size powder lies in the range of 1 to 50 percent, by weight, of the micron size powder. For example, if the powder blend weighs 1,000 grams, then 50 percent by weight of nano size powder would weigh 500 grams.

The reinforcing powder may also comprise nano and fine size particulates, or sub micron to nano size whiskers, nanotubes of carbon. For example, the reinforcing powder may contain one or more of the following:

titanium carbide (TiC),
titanium boride (TiB),
titanium nitride (TiN),
titanium diboride (TiB2),
titanium carbonitride (TiCN), and
alumina (Al2O3).

As mentioned earlier, the mixture is ball-milled, which can be performed using a Unitized Jar Mill (Model No. 784 AVM), manufactured by U.S. Stoneware located at 700 E. Clark Street, East Palestine, Ohio 44413. In one example, the balls were ¼-inch and 3/16-inch alumina, and the mill was run at 110 rpm speed, in a dry condition for two hours in air at room temperature.

Figure 1A:
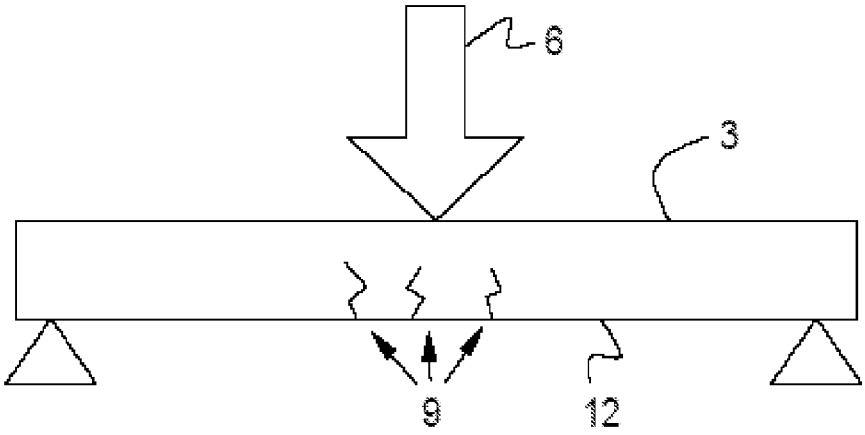
FIGS. 1A and 1B illustrate a non-reinforced concrete beam; and a reinforced concrete beam, respectively.
Figure 1B:
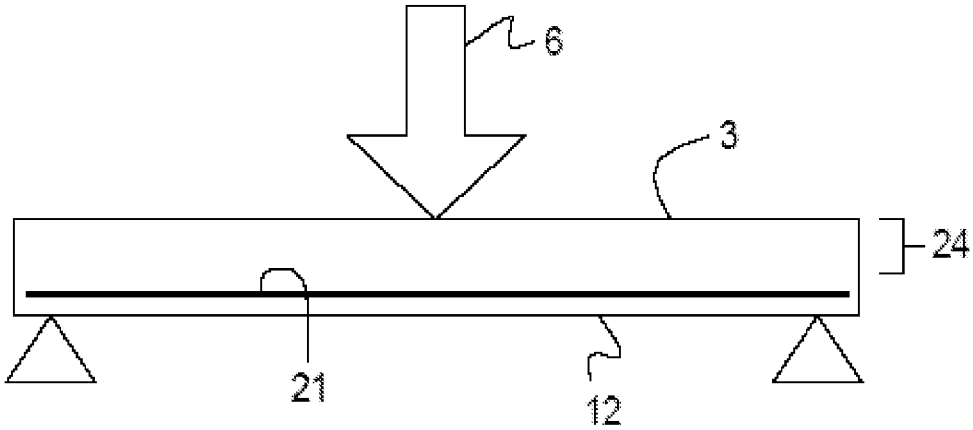
Figure 2:
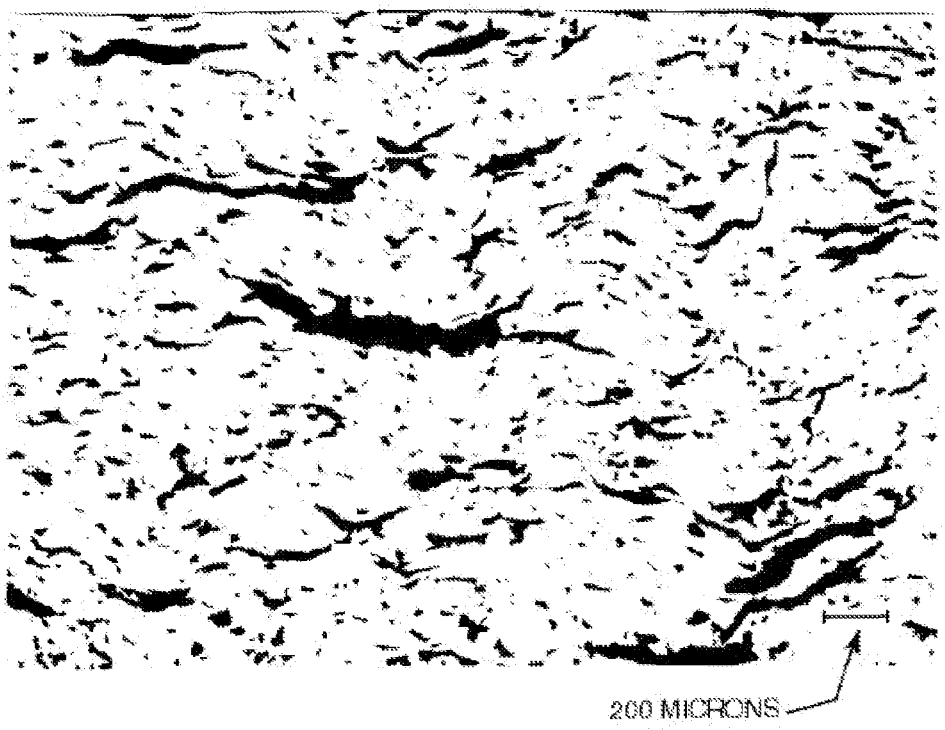
FIG. 2 displays a very heterogeneous microstructure that was achieved after compaction and processing of powder blends mixed using conventional blending methods—the bright areas are metallic phase from micron-size powder, and the dark areas are agglomerated ceramic nano powder regions.
Figure 3:
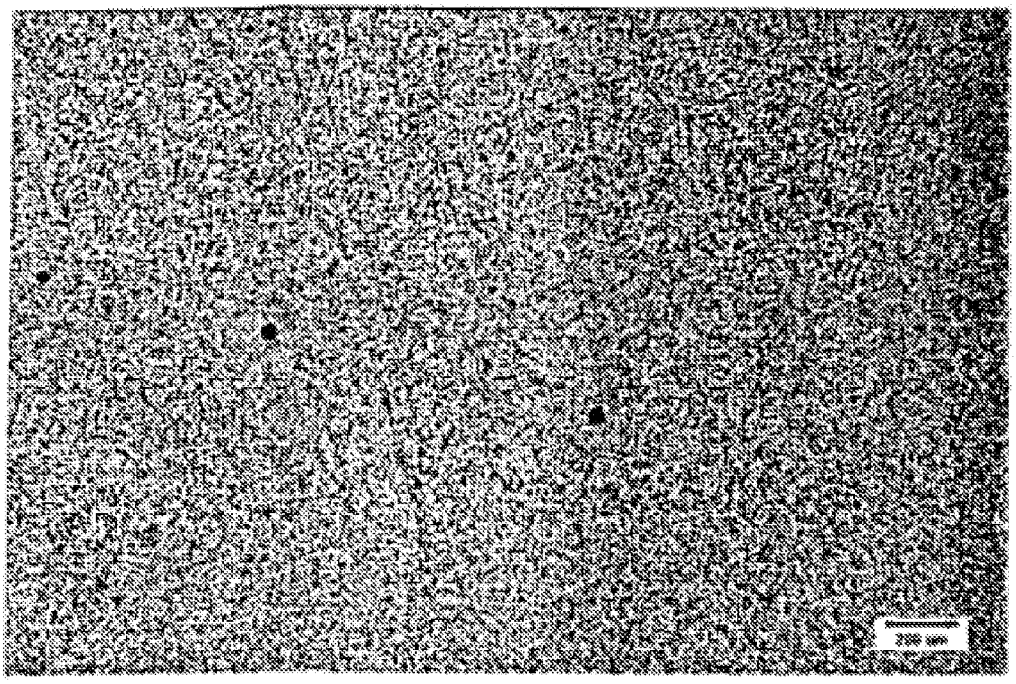
FIG. 3 illustrates an optical micrograph of a sintered substance in which micron sized titanium powder was mixed with nano sized TiC reinforcement using the invention's processing techniques. The light gray areas are titanium and dark areas are TiC.

The mixed powder was then compacted using dynamic magnetic compaction, known in the art, and then sintered at 1260 degrees centigrade for 4 hours under vacuum using known processes. Testing of the sintered composite product using optical microscopy indicated that the titanium matrix and titanium carbides were uniformly dispersed throughout the sintered body, as shown in FIG. 3.

The addition of the nano reinforcement enhanced one or more of the following properties: strength, wear, corrosion resistance, optical, electrical, thermal, and/or catalytic properties of the sintered composite, compared with the sintered body from micron powder alone.

Further, in many cases, the degree of enhancement changes as the concentration of the nano reinforcement changes, sometimes in direct proportion.

It was discovered that a degree of enhancement in hardness is proportional to a weight percent of reinforcement. Also, the degree of enhancement in elastic modulus increased linearly with weight percent of reinforcement.

Additional Considerations

1. The micron powder discussed above, which is also termed the matrix material, was titanium metal. Other matrix materials may include the following:

Ti-6Al-4V,
Ti-6Al-2Sn-4Zr-2Mo,
Ti-6Al-2Sn-4Zr-6Mo,
Ti-6Al-2Zr-2Sn-2Mo-2Cr-0.25Si,
Ti-5Al-2Sn-2Zr-4Mo-4Cr,
Ti-10V-2Fe-3Al,
Ti-15V-3Cr-3Sn-3Al,
Ti-15Mo-3Al-3Nb-0.2Si,
Ti-4.5Al-3V-2Mo-2Fe,
Ti-1Al-8V-5Fe, and
Ti-35V-15Cr,
wherein
Ti refers to titanium,
Al refers to aluminum,
V refers to vanadium,
Sn refers to tin,
Zr refers to zirconium,
Mo refers to molybdenum,
Cr refers to chromium,
Si refers to silicon,
Nb refers to niobium, and
Fe refers to iron.

The numerals refer to relative molar concentrations, not relative weights.

2. In addition to the reinforcement materials discussed above, whiskers or tubes of carbon can be used as mentioned earlier, of diameter 10 nanometers to 100 nanometers.

3. Numerous approaches, known in the art, can be undertaken to compaction of the powder mixture, prior to sintering.

These approaches include dynamic magnetic compaction, conventional pressing, isostatic pressing, and other types of high speed powder compaction and hot isostatic pressing. Thus, it should be understood that both static and dynamic compaction can be used.

4. In one embodiment, sintering is done at temperatures between 1150 and 1300 centigrade, under high vacuum of 10-6 to 10-7 Torr.

5. In the sintered state, the composite body can include needles, plates, acicular bodies, spheroids, and irregularly shaped precipitates. These structures can lie in the nano- or micron size range, and are, in whole or in part, responsible for the enhancement in performance which is achieved.

6. A specific example of increase in hardness is the following. A sample of micron size titanium metal powder of weight 0.75 W was prepared. Nano size titanium carbide weighing 0.25 W was added, and the mixture—with a total weight W—was processed as described herein. An increase in hardness was measured, from 60 HV, for pure sintered titanium, to 697 HV, for the mixture. HV refers to hardness measured on the Vickers scale.

7. The material of point 6, immediately above, was found to display an increase in modulus of elasticity from 100 GPa to 157 GPa. GPa refers to giga-Pascals.

8. One mechanism which is believed to be involved will be explained. The micron size particles (titanium metal in the example above) are softer than the nano size particles. The low energy ball milling causes the harder nano size particles to become embedded within the softer micron size particles. That is, the nano size particles act as a coating.

This coating behavior can be viewed as introducing the following features. One, the effective total number of particles present in the mixture is not equal to the sum of the small and large particles. Instead, many small particles are bound to each large particle to provide a hybrid particle, the total number of hybrid particles is less than the total sum of the small and large particles. This reduced number of particles, each being larger and more massive than the original large particles, may be responsible for the good "flowability" observed in the mixture after ball milling. Good "flowability" is desirable for compaction to high density body prior to the sintering process.

Specific Embodiments

1. Titanium powder of size 50-60 microns was coated with 12 percent by weight titanium carbide powder of size 20 to 40 nanometers and blended in the ball milling process as described above. The mixture was subjected to dynamic magnetic compaction and sintered at 1260 degrees centigrade for 2 hours under high vacuum. The microstructure via optical microscopy is shown in FIG. 3.

It was found that the titanium carbide was well distributed throughout the final product. Further, the titanium carbide exhibited one of two morphologies. The first was a long needle or plate structure, several microns in length, with many or all being longer than 5 microns. The second was clustered acicular particles of dimension in the tens of nanometers.

2. Micron size titanium powders were mixed with nano size titanium carbide powders and processed as described herein. The sintered product of titanium matrix containing 25 percent by weight of titanium carbide reached a hardness of 60 HRC as shown in FIG. 6. The hardness for different weight percentages of titanium carbide is shown in FIG. 6. The hardness increases as the titanium carbide content increases.

Figure 8:
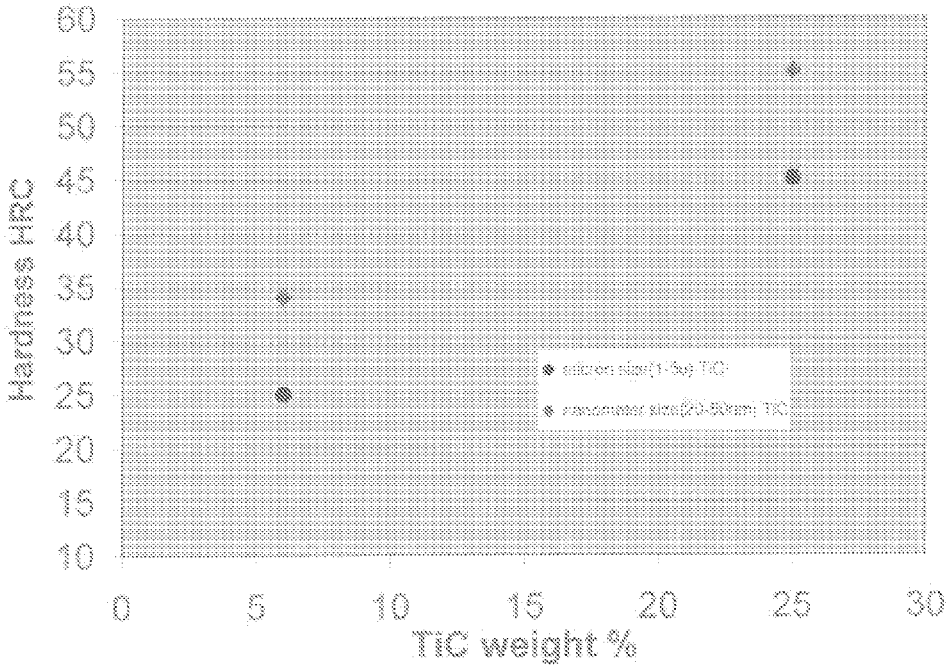
FIG. 8 is a plot of higher hardness enhancement with nano size TiC reinforcements as compared with micron size TiC reinforcements for 6 and 25 weight % titanium carbide particulates.

3. FIG. 8 compares the hardness between titanium (Ti) composites with nano and 1-5 micron reinforcements. The results for TiC composites with 6 and 25 weight % are shown in FIG. 8. Higher hardness was observed with nano reinforcement.

4. FIG. 7 indicates how modulus of elasticity for the sintered product increases as the weight percentage of titanium carbide within titanium metal increases. For example, the modulus increases from about 110 GPa (arrow D) to 157 GPa (arrow E) by addition of 25 percent by weight of nano size titanium carbide.

5. A second type of nano size or fine particles can be added. For example, the second nano particles may be harder than the micron particles, and also harder than the first nano particles. In this example, the second nano particles will become embedded into the larger micron particles, and also into the first nano particles. The second nano particles will thereby form a blended layer.

Conversely, the second nano particle can be softer than both the first nano particles and the micron particles. The hard particles embed into the softer particles.

Figure 4:
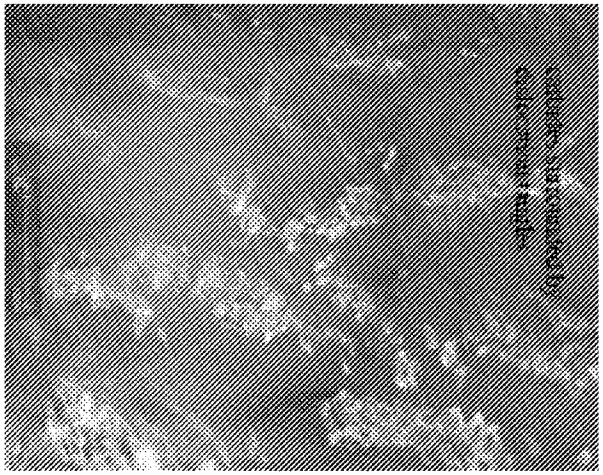
FIG. 4 shows nanometer sized titanium carbides surrounded by dislocation tangles via transmission electron microscopy image.
Figure 5:
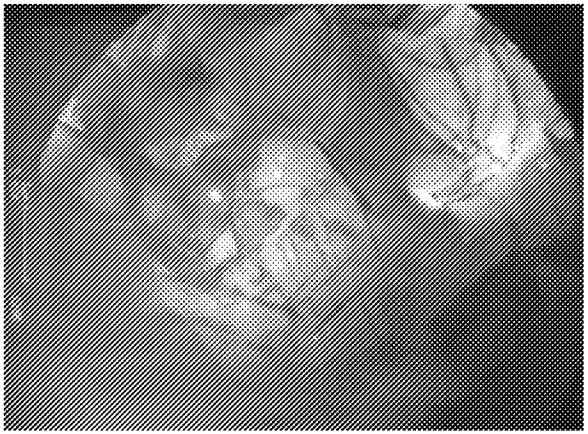
FIG. 5 shows micron size titanium carbides in the needle and platelet form in a composite matrix via transmission electron microscopy image.

Notice that Transmission Electron Microscopy (TEM) of the sintered composite samples showed carbide dispersion throughout the microstructure. FIGS. 4 and 5 show carbide structures in 12 weight %, TiC composite. These carbides exhibited one of two morphologies. The first is that of a long needle or plate microstructure (microns in length) while the second is that of clustered acicular particles with dimensions of the order of tens of nanometers. FIG. 4 shows nanometer size carbides surrounding dislocations. Again, FIG. 5 shows the micron size carbides in needle and platelet form.

DEFINITIONS

1. One definition of a micron size powder is a powder of particle size ranging from 1 to 200 microns.

2. One definition of a nano size powder is a powder of particle size ranging from 1 to 100 nanometers.

3. The dimension of a filament, whisker, or tube is determined by its smallest outer dimension, such as its outer diameter. Thus, a carbon tube which is 10 microns long, with an inner diameter of 100 nanometers and an outer diameter of 200 nanometers would be a 200 nanometer tube.

4. Titanium carbo-nitride, TiCN, is considered to be both a carbide and a nitride of titanium.

5. The phrase "S1/1000" means the quantity S1 divided by one thousand.

6. A definition or illustration of "uniform" can be derived from the following perspective. The concentration of nano particles in any volume can be proportional to the surface area of the micron particles in that volume.

Of course, if sufficient nano particles are added so that they do not all bond to the larger particles, this situation may not occur. The unbonded nano particles will occupy spaces between the larger particles, and may agglomerate into small islands. For example, if a given volume contains a single large micron size particle, and if nano particles coat the large particle in a single layer, then the number of nano particles depends on the surface area of the large particle.

Similarly, if the nano particles coat the micron particle in two or more layers, then again the number of nano particles depends on the surface area of the micron particle. If two different micron particles are present, and are coated with nano particles, then the number of nano particles again depends on the total surface area of the micron particles. Therefore, the concentration of the nano particles, in terms of number of particles in a selected volume, will be proportional to the surface area of the micron particles within that volume.

7. "Diameter" of an irregular particle refers to the largest cross-sectional dimension, as viewed through a microscope. "Diameter" of a filament is the diameter of its cross section. "Diameter" of a plate is the smallest dimension of its cross section, which is probably the thickness in most cases.

8. Although not shown, some of the parts or products made from the above process and powder composite include: bearings and their components, disks, cylinders, rods and tube like shapes, power train components, drive shaft and friction components, and filters.

Numerous substitutions and modifications can be undertaken without departing from the true spirit and scope of the invention. What is desired to be secured by Letters Patent is the invention as defined in the following claims.

What is claimed is:

1. A method comprising:

combining a nano-sized powder of one material with micron-sized particles of another material, said micron-sized particles comprising titanium or its alloys and said nano-sized powder comprising particles having a size of between 1 and 80 nanometers;

ball-milling the powders to produce a mixture in which a number of nano-sized particles in any volume is substantially proportional to a surface area of said micron-sized particles in the volume; and performing said ball-milling step to de-agglomerate said nano-sized particles and cause said nano-sized particles to be generally uniformly dispersed among said micron-sized particles and said nano-sized particles become embedded and bound to a surface of each of the micron-sized particles to provide a coating into or onto each of said surfaces of said micron-sized particles, said nano-sized particles coating said surface of each of said micron-sized particles to provide a hybrid particle with a total number of hybrid particles being less than a total sum of the nano-sized particles and micron-sized particles, with said hybrid particles each being larger than said micron-sized particles;

wherein said ball milling produces said coating of said nano-sized particles into or onto each of said surfaces of said micron-sized particles, with a number of nano-sized particles in any volume being substantially proportional to a surface area of micron-sized particles in said volume for a single layer coating;

each of said hybrid particles being defined by one of said micron-sized particles that has at least one coating of said nano-sized particles on its surface so that at least one layer of said nano-sized particles is spread over of the surface of said micron-sized particles.

2. A method, comprising:

combining micron-sized particles of titanium or its alloy powders with nano-sized particles of a reinforcement, said nano-sized particles being between 1 and 80 nanometers;

agitating the combined particles in a ball mill;

ball-milling said combined particles to de-agglomerate said nano-sized particles and to cause said nano-sized particles to be generally uniformly dispersed among said micron-sized particles, said nano-sized particles becoming coated and bound to a surface of each of said micron-sized particles, said nano-sized particles becoming bound to and coating said surfaces of said micron-sized particles to provide a hybrid particle with a total number of hybrid particles being less than a total sum of the nano-sized particles and micron-sized particles, with said hybrid particles each being larger than said micron-sized particles; and compacting and sintering the agitated and coated particles to thereby produce a sintered product of enhanced hardness than that of pure matrix metal or its alloy;

wherein said ball milling produces said coating of said nano-sized particles into or onto each of said surfaces of said micron-sized particles, with a number of nano-sized particles in any volume being substantially proportional to a surface area of micron-sized particles in said volume for a single layer coating;

each of said hybrid particles being defined by one of said micron-sized particles that has at least one coating of said nano-sized particles on its surface so that at least one layer of said nano-sized particles is spread over of the surface of said micron-sized particles.

3. The method according to claim 2, wherein said micron-sized particles of titanium or its alloy powders comprises one or more of the following:

Titanium,
Ti-6Al-4V,
Ti-6Al-2Sn-4Zr-2Mo,
Ti-6Al-2Sn-4Zr-6Mo,
Ti-6Al-2Zr-2Sn-2Mo-2Cr-0.25Si,
Ti-5Al-2Sn-2Zr-4Mo-4Cr,
Ti-10V-2Fe-3Al,
Ti-15V-3Cr-3Sn-3Al,
Ti-15Mo-3Al-3Nb-0.2Si,
Ti-4.5Al-3V-2Mo-2Fe,
Ti-1Al-8V-5Fe, and
Ti-35V-15Cr.

4. The method according to claim 2, wherein the reinforcement comprises one or more of the following:

titanium carbide (TiC),
titanium boride (TiB),
titanium nitride (TiN),
titanium diboride (TiB2),
titanium carbo nitride (TiCN),
alumina (Al2O3),
carbon fibers,
carbon nanotubes, and
carbon bodies.

5. The method according to claim 2, wherein the titanium is a powder of particle size in the range of 1 micron to 200 microns.

6. The method according to claim 2, wherein the reinforcement is (1) a carbide, nitride, diboride, carbonitride or boride of titanium, (2) alumina, (3) carbon nanotubes or filaments, or (4) a combination of (1), (2), and (3).

7. The method according to claim 2, wherein the individual reinforcements each have a smallest dimension ranging from 1 nanometer to 40 nanometers.

8. A method, comprising the steps of:

combining micron-sized particles of a metal with nano-sized particles of a reinforcement;

agitating the combined particles in a ball mill;

ball-milling said combined particles to de-agglomerate said nano-sized particles and to cause said nano-sized particles to be generally uniformly dispersed among said micron-sized particles and they become coated into or onto surfaces of said micron-sized particles, said nano-sized particles becoming bound to and coating each of said surfaces of said micron-sized particles to provide a hybrid particle with a total number of hybrid particles being less than a total sum of the nano-sized particles and micron-sized particles, with said hybrid particles each being larger than said micron-sized particles;

compacting and sintering the hybrid particles to thereby produce a sintered product of enhanced modulus of elasticity than that fabricated from only particles of a pure metal; and compacting and sintering the hybrid particles to produce a sintered product of enhanced modulus of elasticity and hardness;

wherein said ball milling produces said coating of said nano-sized particles into or onto each of said surfaces of said micron-sized particles, with a number of nano-sized particles in any volume being substantially proportional to a surface area of micron-sized particles in said volume for a single layer coating;

each of said hybrid particles being defined by one of said micron-sized particles that has at least one coating of said nano-sized particles on its surface so that at least one layer of said nano-sized particles is spread over of the surface of said micron-sized particles;

wherein said nano-sized particles have a size of between 1 and 80 nanometers.

9. The method according to claim 8, wherein the metal comprises one or more of the following:

Titanium,
Ti-6Al-4V,
Ti-6Al-2Sn-4Zr-2Mo,
Ti-6Al-2Sn-4Zr-6Mo,
Ti-6Al-2Zr-2Sn-2Mo-2Cr-0.25Si,
Ti-5Al-2Sn-2Zr-4Mo-4Cr,
Ti-10V-2Fe-3Al,
Ti-15V-3Cr-3Sn-3Al,
Ti-15Mo-3Al-3Nb-0.2Si,
Ti-4.5Al-3V-2Mo-2Fe,
Ti-1Al-8V-5Fe, and
Ti-35V-15Cr.

10. The method according to claim 9, wherein the titanium is a powder of particle size in the range of 1 micron to 200 microns.

11. The method according to claim 8, wherein the reinforcement comprises one or more of the following:

titanium carbide (TiC),
titanium boride (TiB),
titanium nitride (TiN),
titanium diboride (TiB2),
titanium carbo nitride (TiCN),
alumina (Al2O3),
carbon fibers,
carbon nanotubes, and
carbon bodies.

12. The method according to claim 11, wherein the reinforcement comprises at least one of (1) a carbide, nitride, diboride, carbonitride or boride of titanium, (2) alumina, (3) carbon nanotubes or filaments, or (4) a combination of a plurality of (1), (2), and (3).

13. The method according to claim 11, wherein the individual reinforcements each have a smallest dimension ranging from 1 nanometer to 40 nanometers.

14. A method, comprising:

dispersing a nanometer size reinforcement powder throughout a micron size metal powder to provide a composite powder having generally uniform dispersion of said nanometer size reinforcement powder;

performing said dispersing to de-agglomerate said nano-sized particles and to cause said nanometer size reinforcement powder to be generally uniformly dispersed among said micron size metal powder and said nanometer size reinforcement powder becomes coated and bound to each surface of said micron size metal powder, said nanometer size reinforcement powder having a size of between 1 and 80 nanometers and coating said surface of said micron size metal powder to provide a hybrid particle with a total number of hybrid particles being less than a total sum of the nano-sized particles and micron-sized particles, with said hybrid particles each being larger than said micron-sized particles; and compacting and sintering the composite powder to produce a sintered body having nanometer sized ceramic bodies generally uniformly distributed throughout the sintered body wherein said dispersing produces said coating of said nano-sized particles into or onto each of said surfaces of said micron-sized particles, with a number of nano-sized particles in any volume being substantially proportional to a surface area of micron-sized particles in said volume for a single layer coating;

each of said hybrid particles being defined by one of said micron-sized particles that has at least one coating of said nano-sized particles on its surface so that at least one layer of said nano-sized particles is spread over of the surface of said micron-sized particles.

15. The method as recited in claim 14, wherein the method further comprises the step of:

compacting or other consolidation methods of the composite powder using at least one of the following: a Dynamic Magnetic Compaction (DMC) process, a conventional press, Hot Isostatic Press (HIP) or other forms of hot pressing, dynamic or static compaction processes (including injection molding and extrusion) before said sintering step.

16. The method as recited in claim 14, wherein the sintering step comprises the step of:

sintering the composite at temperatures between 1150° C. to 1300° C. and under high vacuum (10-6-10-7 torr).

17. The method as described in claim 14, wherein said sintered body may comprise a morphology of needles, plates, acicular, spheroids, or irregular shaped precipitates of both nano and micron size that result in performance enhancement.

18. The method as described in claim 14, wherein said method comprises the step of:

increasing the properties of the sintered metal as a function of reinforcement concentration.

19. The method as described in claim 18, wherein said increasing step comprises the step of:

increasing hardness of pure titanium value by increasing the amount of TiC nano particulates.

20. The method as recited in claim 14, wherein said dispersing step is performed by ball-milling.

* * * * *